US007121033B1

(12) United States Patent
Waller

(10) Patent No.: US 7,121,033 B1
(45) Date of Patent: Oct. 17, 2006

(54) GUN LOCK

(76) Inventor: Ray Waller, P.O. Box 576, Shelby, MT (US) 59474

( * ) Notice: Subject to any disclaimer, the term of this patent is extended or adjusted under 35 U.S.C. 154(b) by 0 days.

(21) Appl. No.: 10/908,865

(22) Filed: May 30, 2005

(51) Int. Cl.
*F41A 17/00* (2006.01)

(52) U.S. Cl. ..... 42/70.11

(58) Field of Classification Search ..... 42/70.11, 42/70.01

See application file for complete search history.

(56) References Cited

U.S. PATENT DOCUMENTS 2,327,334 A * 8/1943 Parker ..... 42/70.11
2,887,807 A * 5/1959 Santangelo ..... 42/70.11
3,022,598 A * 2/1962 Wikstrom ..... 42/66
4,398,366 A * 8/1983 Wernicki ..... 42/70.11
4,783,924 A * 11/1988 Thurber ..... 42/70.11
5,491,918 A * 2/1996 Elmstedt ..... 42/70.11
5,860,241 A 1/1999 Waters
5,950,344 A 9/1999 Ross
6,408,556 B1 6/2002 Achee et al.
6,418,654 B1 7/2002 Trois et al.
6,862,831 B1 3/2005 Canaday
6,895,707 B1 * 5/2005 Young ..... 42/70.11

* cited by examiner

*Primary Examiner*—Michelle Clement
(74) *Attorney, Agent, or Firm*—Bay Area Patent Group, LLC

(57) ABSTRACT

A firearm barrel lock for preventing the accidental or unauthorized discharge of a firearm is provided. The barrel lock includes a dummy cartridge that is adapted to be received by a cartridge chamber of a firearm, a shaft that is insertable down the bore of the firearm and includes a first end that is engagable the dummy cartridge, and a lock that is releasable secured to a second end of the shaft which extends beyond the end of the barrel which precludes the removal of the shaft from the barrel.

8 Claims, 3 Drawing Sheets

GUN LOCK

FIELD OF THE INVENTION

The present invention relates generally to firearm safety devices. More particularly, relating to a firearm barrel lock for preventing unauthorized or accident discharge of a firearm.

SUMMARY OF THE INVENTION

In accordance with the present invention, an apparatus for preventing unauthorized or accident discharge of a firearm is provided.

In general, in one aspect, a firearm barrel lock is provided. The barrel lock includes a dummy cartridge that is adapted to be received by a cartridge chamber of a firearm. The dummy cartridge is of a dimension to correspond with a round of ammunition for the firearm and includes a longitudinal slot that extends from a forward end of the dummy cartridge and which terminates approximate a reward end at two opposed forward turned notches. A shaft insertable into the barrel of the firearm, the shaft having a first T-shaped end which is releasably inserted into the longitudinal slot and is engagable with the two opposed forward turned notches and a second end which terminates beyond the end of the barrel. A spring positioned around the shaft approximate the first end, and a lock that is releasably secured to the second end of the shaft and having a dimension preventing the lock from entering the barrel.

In general, in another aspect, the second end of the shaft includes a plurality of radial grooves formed around the circumference thereof which are adapted to releasably receive a corresponding lock tumbler of the lock.

In general, in another aspect, the second end of the shaft terminates at a flanged end, thereby preventing complete removal of the lock from the second end.

In general, in another aspect, the dummy cartridge is ejectable from the firearm through normal operation of the firearm.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE INVENTION

Figure 1:
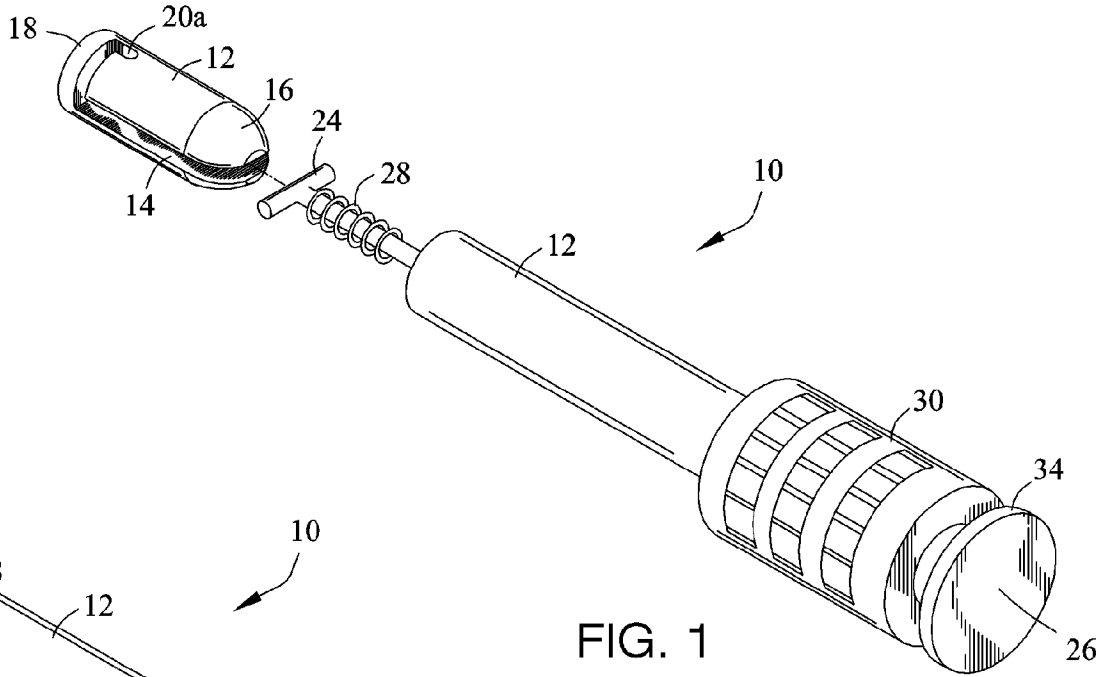
FIG. 1 is a perspective exploded assembly view of the preferred embodiment of the gun barrel lock constructed in accordance with the principles of the present invention.
Figure 2:
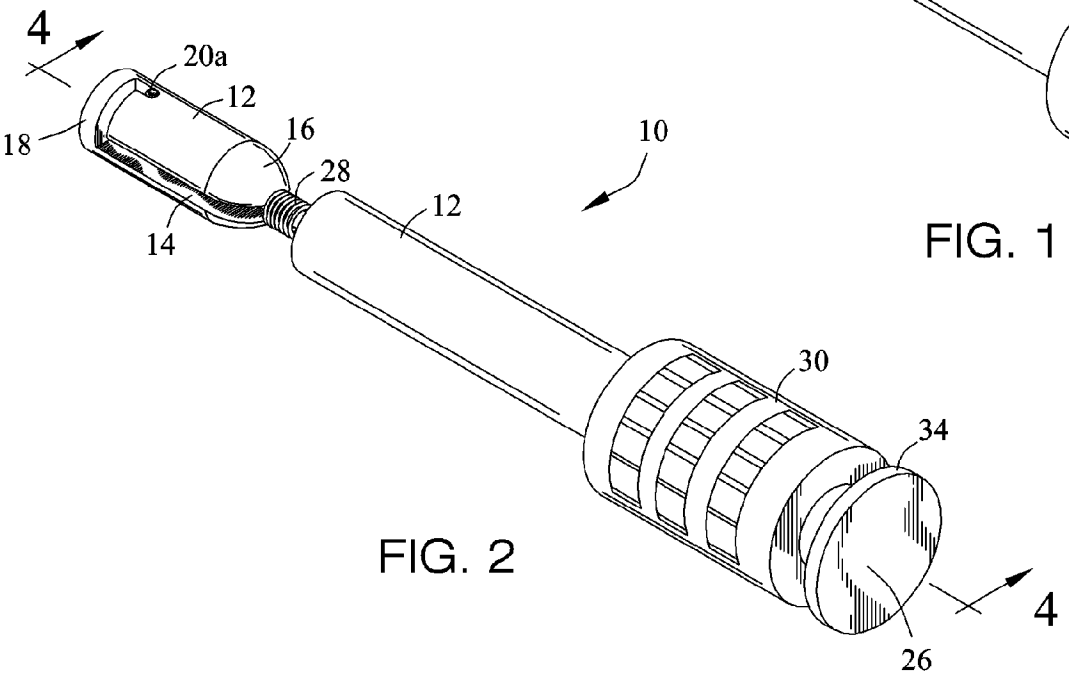
FIG. 2 is a perspective assembled view of the gun barrel lock.
Figure 3:
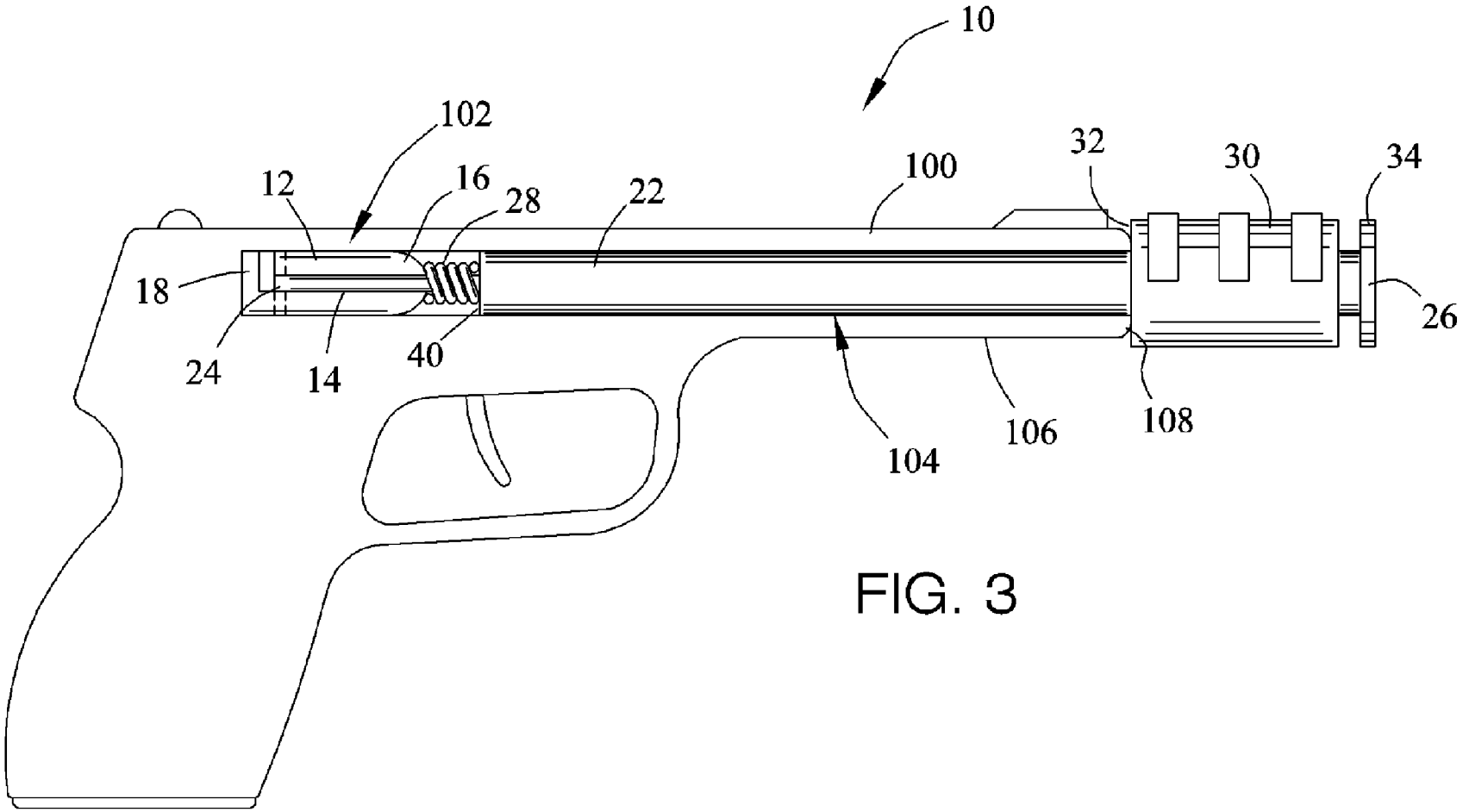
FIG. 3 is a side elevation view of the gun barrel lock in use with an exemplary firearm.
Figure 4:
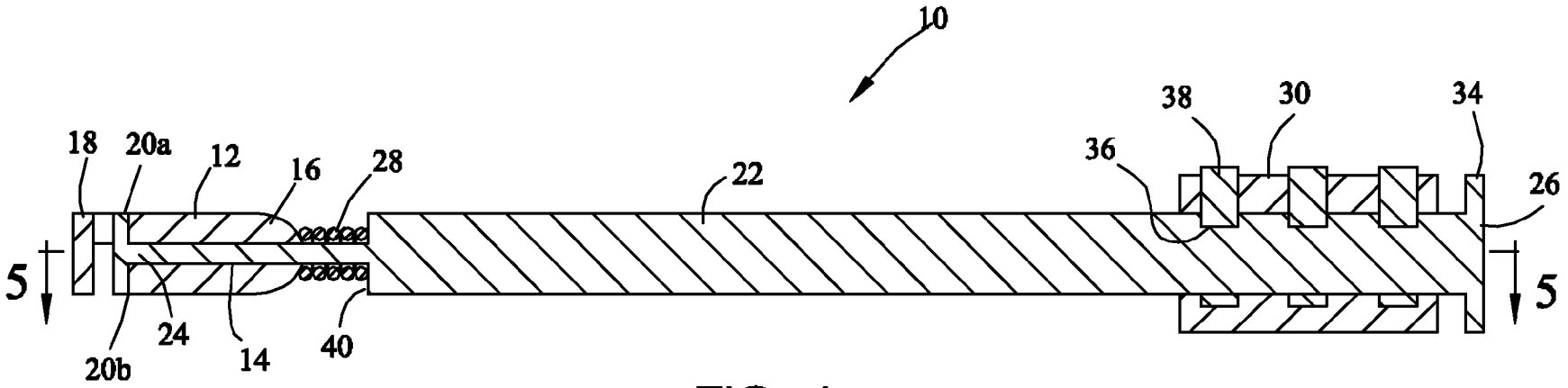
FIG. 4 is a cross sectional view taken along line 4—4 in FIG. 3.
Figure 5:
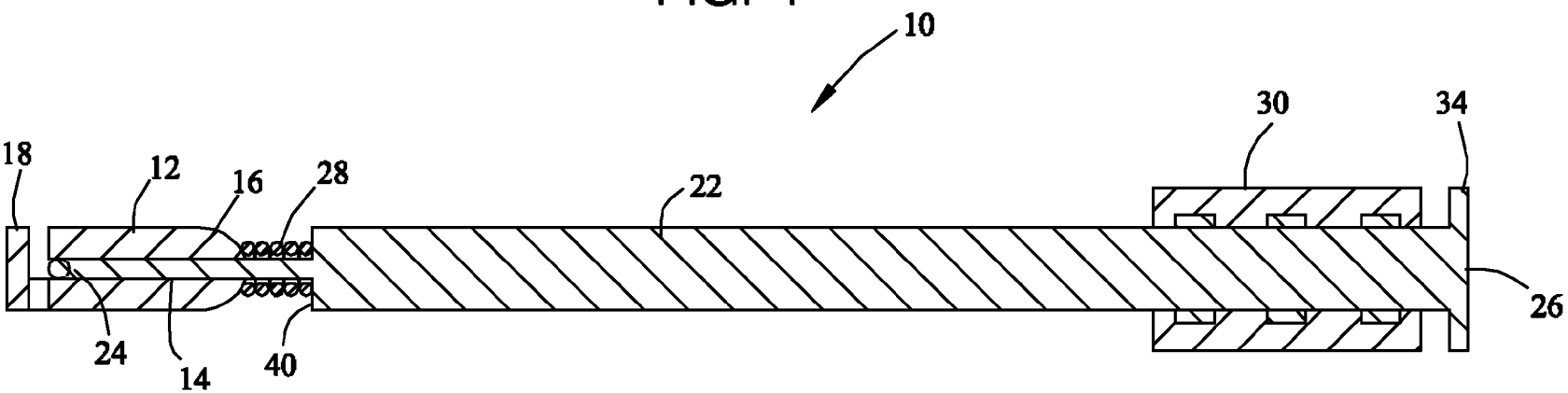
FIG. 5 is a cross section view take along line 5—5 in FIG. 4.

Referring now to the drawings, and particularly to FIGS. 1–5 thereof, a firearm barrel lock embodying the principles and concepts of the present invention and generally designated by the reference numeral 10 will be described.

As best illustrated in FIGS. 1 through 5, the firearm barrel lock 10 generally comprises a device 10 for preventing the unauthorized or accidental discharge of a firearm. The device 10 includes a dummy cartridge 12 of a dimension to correlate with a round of ammunition for a firearm 100 which the barrel lock 10 is to be used. The dummy cartridge 12 is of a solid body construction and includes a longitudinal slot 14 formed axially therein from a forward face 16 to approximate a rearward face 18. The longitudinal slot 14 terminates approximate the rearward face at two opposed forward turned notches 20*a* and 20*b*. The dummy cartridge 12 is adapted to be received by the cartridge chamber, generally designated by 102, of the firearm 100 and is positioned therewithin such that the longitudinal slot 14 is axially aligned with bore 104 of the barrel 106 of the firearm and such that the forward face 16 is facing towards the front of the firearm.

A shaft 22 is adapted to be inserted through the bore 104 and includes a first T-shaped end 24 and a second end 26 which terminates a distance beyond the end of the barrel 106. The first end 24 of the shaft 22 is inserted through the bore 104 and into the longitudinal slot 14 of the dummy cartridge 12. The shaft 22 is then rotate so as to engage the T-shaped first end 24 with the two opposed forward turned notches 20*a* and 20*b*. With the first end 24 engaged with the notches 20*a* and 20*b*, the shaft is prevented from being withdrawn from the barrel 106.

A biasing means 28, such a spring is positioned about the first end 24 in such a manner that during the insertion of the first end into the longitudinal slot 14, the spring abuts and is compressed by the forward face 16 of the dummy cartridge 12. Force exerted by compressed spring 28 acts urge the first end 24 in a direction toward the forward face the dummy cartridge 12 or in other words acts to push the shaft 22 in a direction outward of the barrel 106. However, when the shaft 22 is inserted into the dummy cartridge 12 and rotated such that the T-shaped first end 24 is engaged with the two opposed forward turned notches 20*a* and 20*b*, the force exerted by the spring 28 acts to retain the T-shaped first end engaged with the two opposed notches, thereby preventing removal of the shaft from the barrel 106 of the firearm 100. To remove the shaft 22 from the dummy cartridge 12 and from the barrel 106, the shaft must be pushed into the barrel 106 in direction towards the rearward face of the dummy cartridge 12. The shaft 22 must be pushed in this direction with enough force to overcome the force exerted by the spring 28 allowing the first end 24 of the shaft to be displaced toward the rearward face 18 of the dummy cartridge 12 so that the shaft can be rotated and disengage the first end from the two opposed forward turned notches 20*a* and 20*b*, thereby allowing removal of the shaft from the dummy cartridge and from the barrel.

A lock 30 is releasably secured to the second end 26 of the shaft 22 and is of a dimension, which precludes the lock from entering the barrel 106. The lock 30 is positionable in a first position where it is locked to the second end 26 of the shaft 22 and prevents the shaft from being pushed inward into the barrel 106, thereby preventing the shaft from being removed from the dummy cartridge 12 and securing the firearm against discharge. The lock 30 when unlocked, is positionable in a second position where the shaft 22 is free to be pushed inward into the barrel 106, thereby allowing the inserting or removal of the shaft from the dummy cartridge 12. The lock 30, includes a surface 32 which abuts the end 108 of the barrel 106 when in the first locked position on the shaft 22.

In another configuration, the second end 26 of the shaft 22 terminates at a radial flange 34. The flange 34 precludes the lock 30 from being completely removed from the shaft 22, thereby preventing misplacement of the lock.

In yet another configuration, the second end 26 of the shaft 22 includes notches 36 or the like, which are adapted to releasably receive at least one lock tumbler 38 of the lock 30. Further yet, the lock 30 can be of a key type lock or of a combination lock.

In yet another configuration, the first end 24 of the shaft 22 is diametrically reduced from the second end 26, which defines an abutment 40 which an end of the spring 28 is compressed against when the first end is inserted into the dummy cartridge 12.

It is important to note, that while the firearm barrel lock 10 is illustrated as being used with a semi-automatic hand gun 100, the firearm barrel lock is usable various other firearms, such as a revolver, a shot gun and a rifle.

It now can be understood in use, the dummy cartridge 12 is inserted into an ammunition receiving chamber of a firearm 100 with the forward face 16 point forward down the barrel 106 with the longitudinal slot 14 aligned with the bore 104 of the barrel. Next, the T-shaped first end 24 of the shaft 22 is inserted into the bore 104 of the barrel and is aligned with the longitudinal slot 14 of the dummy cartridge 12 and is inserted through the full length of the longitudinal slot. At this point, the shaft 22 is rotated so as to engage the T-shaped first end 24 with the two opposed forward turned notches 20*a* and 20*b*. The force of the spring 28 acts to retain the T-shaped first end 24 engaged with the forward turned notches 20*a* and 20*b*. The lock 30, is then positioned in the first position along the second end 26 of the shaft 22 and is locked in place. The firearm 100 is now completely disarmed and secured from unauthorized or accidental discharge.

To release the firearm barrel lock 10 from the firearm 100, an authorized user simply unlocks the lock 30, and in a single motion pushes the shaft 22 into the barrel and rotates the shaft to disengage the first end 24 from the dummy cartridge. Once the shaft 22 is disengaged from the dummy cartridge 12, the shaft is quickly withdrawn from the barrel 106 and through normal use of the firearm, such as pulling the slide of a semi-automatic hand gun or pulling the hammer of a revolver, the dummy cartridge is discharged from the cartridge chamber 102 of the firearm 100, and firearm 100 is armed and ready for use.

A number of embodiments of the present invention have been described. Nevertheless, it will be understood that various modifications may be made without departing from the spirit and scope of the invention. Accordingly, other embodiments are within the scope of the following claims.

What is claimed is:

1. A firearm barrel lock for preventing unauthorized or accidental discharge of a firearm having a barrel and a cartridge chamber, the barrel lock comprising:

a dummy cartridge including a longitudinal slot that extends from a forward end thereof and terminating approximate a reward end at two opposed forward turned notches, said dummy cartridge is receivable by a cartridge chamber of a firearm and being of a dimension to correspond with a round of ammunition for the firearm;

a shaft having first and second ends, the first end being diametrically reduced from the second end so as to define an abutment, the first end being T-shaped and removably insertable through a barrel of a the firearm into the longitudinal slot of said dummy cartridge and is engagable with the two opposed forward turned notches to prevent withdrawal of said shaft from said dummy cartridge, and the second end terminating beyond the end of the barrel;

a spring positioned about the diametrically reduced first end of said shaft intermediate the T-shaped end and the abutment, said spring contactable with a forward face of said dummy cartridge and being compressed between the forward end of said dummy cartridge and the abutment when said shaft is inserted into the longitudinal slot, thereby urging said shaft in a direction outward of the longitudinal slot; and a lock being releasably secured to the second end to prevent the disengagement of the T-shaped end from the two opposed forward turned notches, said lock being a dimension preventing said lock from entering the barrel.

2. The firearm barrel lock of claim 1, wherein said dummy cartridge is of a solid body construction.

3. The firearm barrel lock of claim 1, wherein said lock is a combination lock and the second end of said shaft includes a plurality of radial grooves formed around the circumference thereof which releasably receive a corresponding lock tumbler of said lock.

4. The firearm barrel lock of claim 1, wherein said lock is slidable along the second end of said shaft and is positionable in a first locked position and in a second unlocked position, and further includes a rearward facing surface which is abuttable with the end of the barrel when said lock is positioned in the first locked position, and wherein the second end of said shaft terminates at a flanged end, thereby preventing removal of said lock from said second end.

5. The firearm barrel lock of claim 1, wherein said dummy cartridge is of dimensions so as to permit said dummy cartridge to be ejected from the firearm through normal operation of the firearm.

6. A firearm barrel lock for preventing unauthorized or accidental discharge of a firearm having a barrel and a cartridge chamber, the barrel lock comprising:

a dummy cartridge of a solid body construction including a longitudinal slot that extends from a forward end thereof and terminating approximate a reward end at two opposed forward turned notches, said dummy cartridge is receivable by a cartridge chamber of a firearm and being of a dimension to correspond with a round of ammunition for the firearm;

a shaft having first and second ends, the first end being diametrically reduced from the second end so as to define an abutment, the first end being T-shaped and removably insertable through a barrel of a the firearm into the longitudinal slot of said dummy cartridge and is engagable with the two opposed forward turned notches to prevent withdrawal of said shaft from said dummy cartridge, and the second end terminating beyond the end of the barrel;

a spring positioned about the diametrically reduced first end of said shaft intermediate the T-shaped end and the abutment, said spring contactable with a forward face of said dummy cartridge and being compressed between the forward end of said dummy cartridge and the abutment when said shaft is inserted into the longitudinal slot, thereby urging said shaft in a direction outward of the longitudinal slot; and a lock being releasably secured to the second end to prevent the disengagement of the T-shaped end from the two opposed forward turned notches, said lock being a dimension preventing said lock from entering the barrel, and wherein the second end terminates at a flanged end preventing removal of said lock from the second end.

7. The firearm barrel lock of claim 6, wherein said lock is a combination lock and the second end of said shaft includes a plurality of grooves formed therein which each releasably receive a corresponding lock tumbler of said lock.

8. The firearm barrel lock of claim 6, wherein said dummy cartridge is of dimensions so as to permit said dummy cartridge to be ejected from the firearm through normal operation of the firearm.

* * * * *